United States Patent [19]

Akkala et al.

[11] Patent Number: 4,911,108

[45] **Date of Patent: * Mar. 27, 1990**

[54] WATER HEATER CONSTRUCTION

[75] Inventors: Marc W. Akkala, New Berlin; Dennis R. Hughes, Germantown, both of Wis.

[73] Assignee: A. O. Smith Corporation, Milwaukee, Wis.

[ * ] Notice: The portion of the term of this patent subsequent to Apr. 4, 2006 has been disclaimed.

[21] Appl. No.: 294,887

[22] Filed: Jan. 9, 1989

Related U.S. Application Data

[63] Continuation of Ser. No. 170,789, Mar. 21, 1988, Pat. No. 4,817,564.

[51] Int. Cl.[4] ..... F22B 5/00

[52] U.S. Cl. ..... 122/17; 122/14; 126/361

[58] Field of Search ..... 122/17, 14; 126/391, 126/392; 431/343

[56] References Cited

U.S. PATENT DOCUMENTS

| | | | |
|---|---|---|---|
| 953,958 | 4/1910 | Kelley . | |
| 1,616,143 | 2/1927 | Schnepp . | |
| 1,908,149 | 5/1933 | Horton . | |
| 2,276,381 | 3/1942 | Faeber . | |
| 2,345,677 | 4/1944 | Koppel . | |
| 2,348,901 | 5/1944 | Handley . | |
| 2,479,042 | 8/1949 | Gaines . | |
| 2,480,657 | 8/1949 | Jones . | |
| 2,526,015 | 10/1950 | Figg et al. . | |
| 2,541,175 | 2/1951 | Osterheld | 122/17 |
| 2,563,817 | 8/1951 | Carson . | |
| 2,684,054 | 7/1954 | Carson . | |
| 2,790,428 | 4/1957 | Buttler | 122/17 |

*Primary Examiner*—Edward G. Favors

*Attorney, Agent, or Firm*—Andrus, Sceales, Starke & Sawall

[57] ABSTRACT

A water heater comprising a tank to contain water to be heated and having a downwardly convex lower head. A flue extends upwardly through the tank and the lower end of the flue projects downwardly beyond the lower head. A burner having a substantially smaller cross-sectional area than the flue is located adjacent the lower end of the flue, and a locator interconnects the projecting lower end of the flue with the burner for precisely positioning the burner with relation to the flue. A layer of insulation is disposed on the outer surface of the convex lower head and extends radially inward to the projecting end of the flue.

11 Claims, 3 Drawing Sheets

FIG. 1
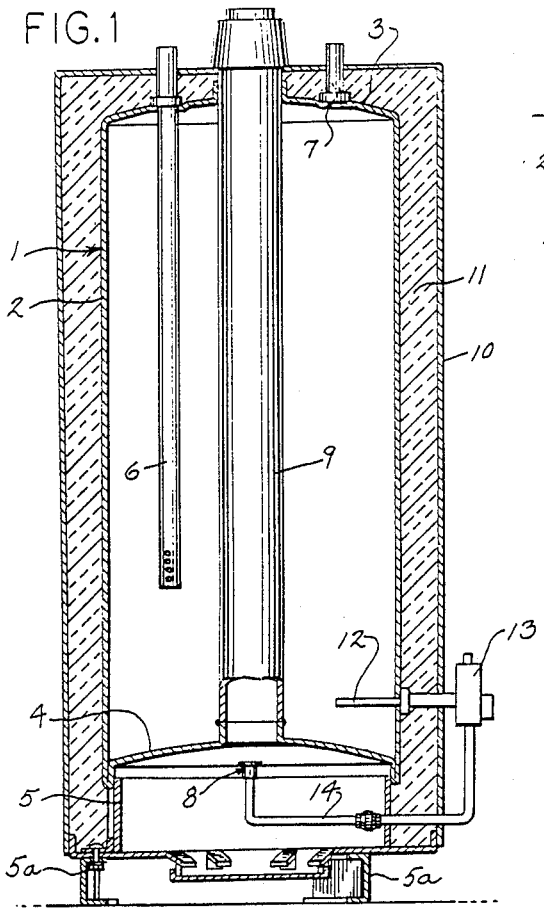
FIG. 3
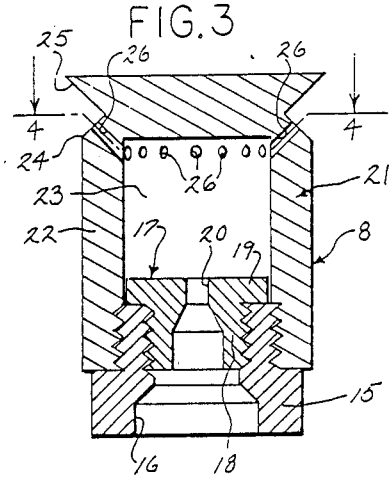
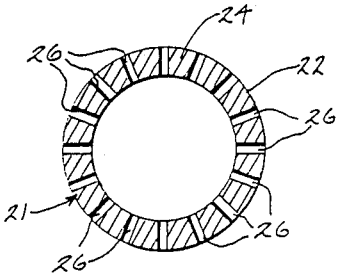
FIG. 4
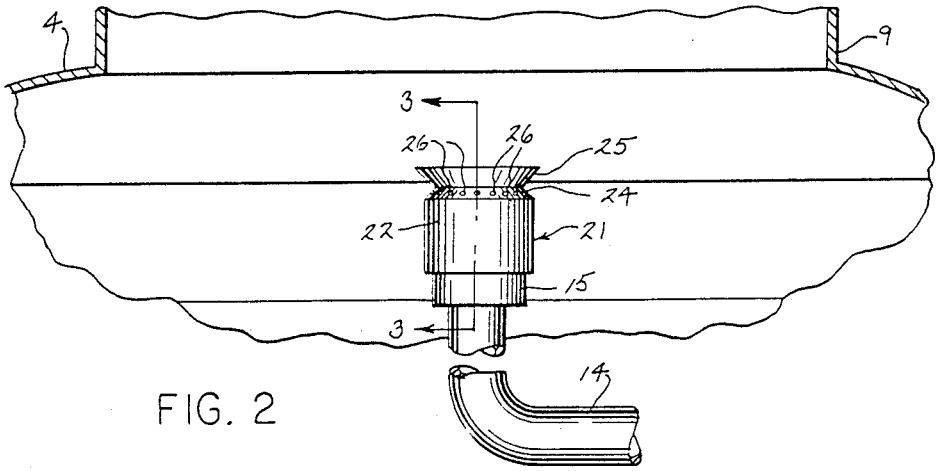
FIG. 2

FIG. 5
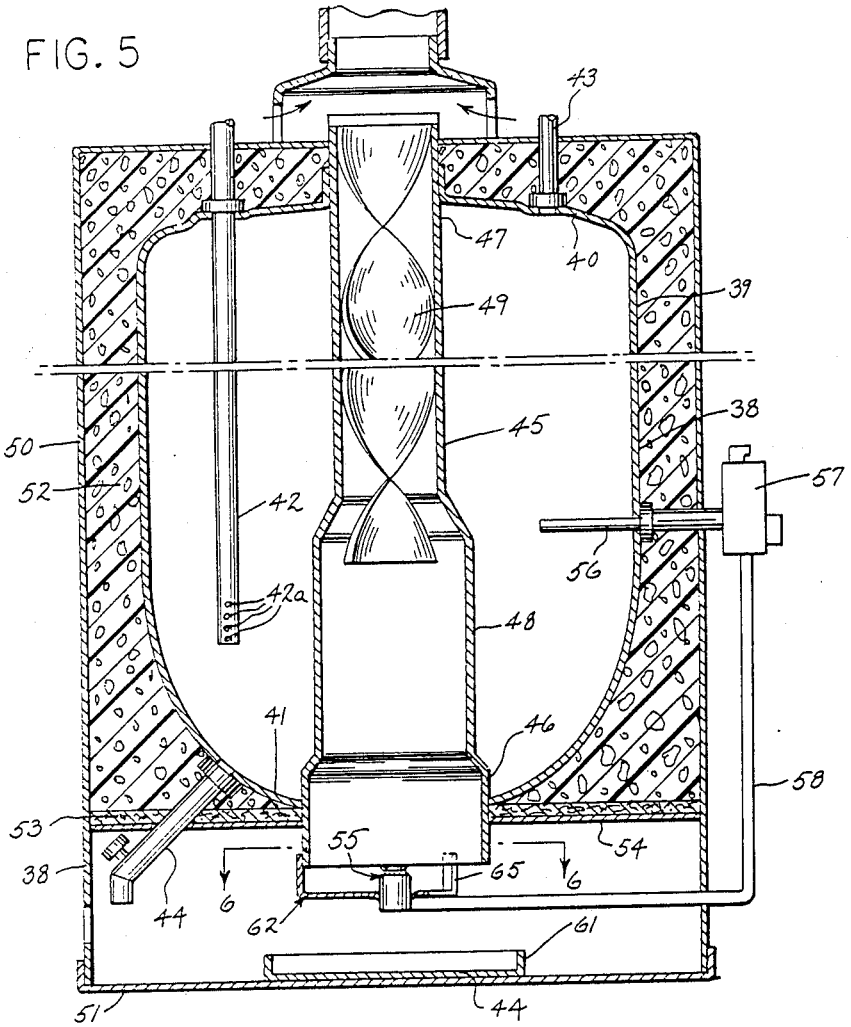
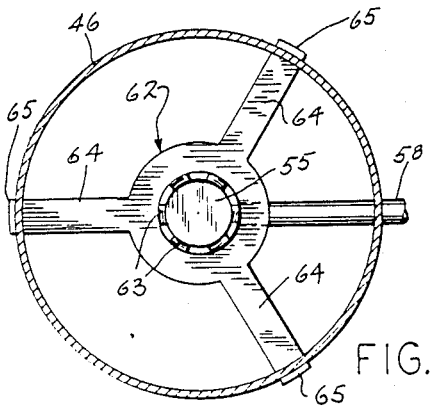
FIG. 6
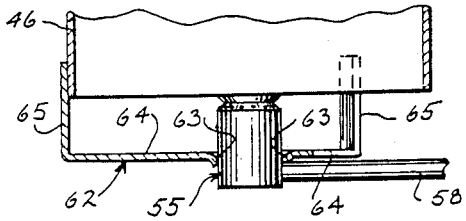
FIG. 7

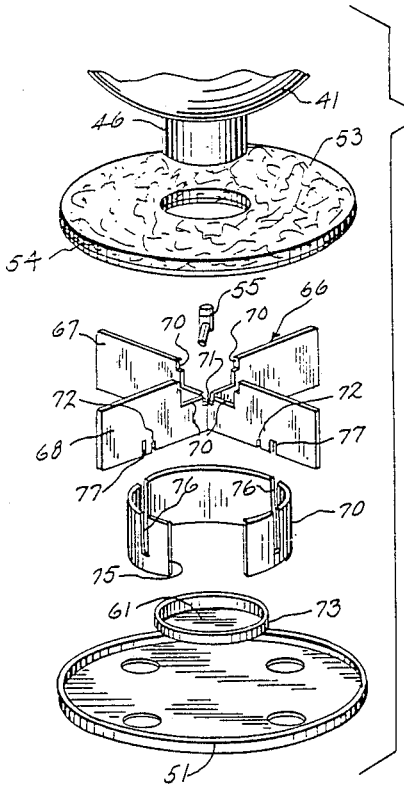
FIG. 8
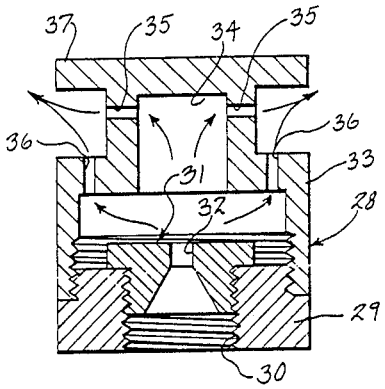
FIG 10
FIG. 9
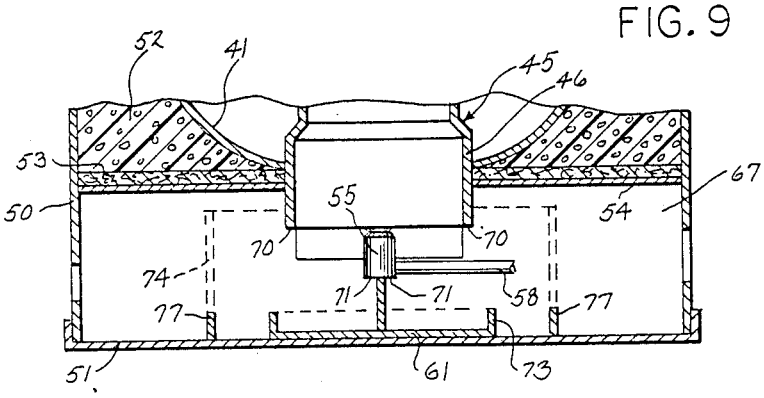

WATER HEATER CONSTRUCTION

This is a continuation of application Ser. No. 07/170,789, filed Mar. 21, 1988 U.S. Pat. No. 4,817,564.

BACKGROUND OF THE INVENTION

The conventional domestic, gas-fired water heater includes a generally cylindrical tank to contain water to be heated and a gas burner is located beneath the lower head of the tank. Waste gases of combustion generated by combustion of the gas, are discharged through one or more flues which extend upwardly through the tank. Heat is transfered from the combustion to the water in the tank as the heated gases pass across the bottom head and the flues.

To decrease the overall height of the water heater, it has been proposed to make the burner relatively shallow in vertical dimension, and to utilize a burner head of substantial diameter in which the gas is discharged through a plurality of ports arranged in a circular pattern so that the flame will be projected outward, horizontally beneath the lower head of the tank.

The lower head of the conventional gas fired water heater is upwardly concave so that the waste gases of combustion generated by the burner, which is located beneath the lower head, will be funneled radially inward to the central flue or flues. The use of a concave lower head has certain disadvantages in that it reduces the volume per unit length of the tank, as compared to a convex lower head, and requires the use of heavier gauge metal than a convex lower head. In addition, the concave lower head is not usually insulated because of the high temperature of the waste gases of combustion that it funnels into the flue or flues.

SUMMARY OF THE INVENTION

The invention is directed to an improved gas-fired water heater, and in particular, to a novel gas burner construction in which a small diameter burner is located at the lower end of the flue.

The water heater of the invention includes a vertical, generally cylindrical tank to contain water to be heated and a flue that extends axially through the tank. The burner of the invention is located at the lower end of the flue and has a substantially smaller diameter than the flue to provide an annular space or clearance between the burner and the lower end of the flue.

The burner is composed of a base having a central passage with one end of the passage connected to a gas supply line, while an orifice member is mounted in the other end of the passage and defines a small diameter orifice.

An inverted cup-shaped head is connected to the base and defines a chamber that communicates with the orifice. A plurality of outlet ports provide communication between the chamber and the exterior of the burner. In one form of the invention the ports extend at an acute angle to the horizontal, while in a second form of the invention, one group of ports extends horizontally, while a second group of ports extends vertically.

The upper end of the burner head constitutes a shield which extends outwardly beyond the ports and acts to prevent foreign material from falling onto or lodging in the ports.

With the burner of the invention, both the orifice member and the head are removable and replaceable so that the gas energy delivery rate, as well as the flame pattern, can be controlled to optimize the combustion zone configuration for the particular installation.

Preferably, the flame pattern is designed so that the flame is in proximate relation to the inner surface of the lower end of the flue, but does not directly impinge on the flue.

While the construction of the invention can be utilized with a conventional water heater having a concave lower head, the invention has particular application to a water heater having a convex lower head. As the burner is located at the lower end of the flue, the flame pattern will be generated within the flue and, thus, there is no necessity for the lower head to be concave to funnel the waste gases toward the flue, or flues. Accordingly, the lower head of the water heater tank can be insulated to substantially reduce standby heat loss.

As the flame pattern is located within the lower end of the flue, heat loss from the bottom of the water heater during firing is minimized.

As a further advantage, condensate resulting from the combustion process will flow downwardly along the inner wall of the flue and will not contact the flame or burner, thus preventing interference with the combustion process and minimizing corrosion of the burner components.

With the invention, scale or sediment buildup on the bottom head of the tank will not adversely effect the performance, because heat transfer from the combustion process is through the flue to the water of the tank, rather than through the bottom head as in a conventional water heater utilizing a large diameter burner and a concave lower head.

Since combustion does not take place beneath the lower head, the invention allows the use of a non-metallic tank construction.

Other objects and advantages will appear in the course of the following description.

DESCRIPTION OF THE DRAWINGS

The drawings illustrate the best mode presently contemplated of carrying out the invention.

In the drawings:

FIG. 1 is a vertical section of a typical water heater incorporating the burner construction of the invention;

FIG. 2 is an enlarged fragmentary vertical section showing the flue and burner;

FIG. 3 is a section taken along line 3—3 of FIG. 2;

FIG. 4 is a section taken along line 4—4 of FIG. 3;

FIG. 5 is a vertical section of a modified form of the water heater of the invention;

FIG. 6 is a section taken along line 6—6 of FIG. 5;

FIG. 7 is an enlarged fragmentary side elevation of the burner and lower end and the flue.

FIG. 8 is an exploded view of a modified form of locator;

FIG. 9 is a fragmentary vertical section showing the locator of FIG. 9 associated with a water heater; and FIG. 10 is a longitudinal section of a modified form of the burner.

DESCRIPTION OF THE ILLUSTRATED EMBODIMENT

FIGS. 1–4 illustrate the invention in association with a conventional water heater. FIG. 1 shows a typical water heater including a vertical tank 1 to contain water to be heated. Tank 1 includes a generally cylindrical shell 2 which is enclosed at its upper end by a convex upper head 3 and at its lower end by an upwardly concave lower head 4. A generally cylindrical skirt 5 extends downwardly from lower head 4 and a series of legs 5a are connected to the lower edge of the skirt and serve to support the water heater from a foundation or floor. Water is introduced into the tank through a dip tube 6 mounted in an opening in head 3, and heated water is withdrawn from the tank through outlet pipe 7.

A burner 8 is located beneath the tank and waste gases of combustion generated by burner 8 are discharged upwardly through a central flue 9 which is mounted in aligned openings in heads 3 and 4.

The interior surfaces of tank 1, as well as the exterior surface of flue 9, can be coated with a corrosion resistant material such as glass or porcelain enamel, not shown.

Surrounding tank 1 is a jacket 10 and a layer of insulating material 11 is positioned between the jacket 10 and tank 2.

A conventional thermostat 12 is mounted within an opening in the shell 2 of tank 1 and operates a gas supply valve 13 which supplies gas through a supply tube 14 to burner 8.

An ignition device, not shown, can be mounted adjacent the burner to ignite the gas being discharged from the burner in a conventional manner.

Burner 8 includes a base 15 having a central passage 16 and an end of the gas supply tube 14 is secured in sealed relation to the end of passage 16.

Threaded in the opposite end of passage 16 is an orifice_member 17, which is composed of a threaded stem 18 and enlarged upper head 19 that defines a small diameter orifice 20.

Secured to the end of base 15 is an inverted generally cup-shaped head 21. Head 21 is composed of a lower section 22 which is threaded to base 15 and defines a chamber 23 that communicates with orifice 20.

As illustrated in FIG. 3, the end of section 22 terminates in an upwardly converging surface 24 which extends upwardly and inwardly at an angle of about 30° to 60° to the horizontal, and preferably about 45°, to the horizontal. Diverging surface 25 extends upwardly and outwardly from surface 24 and is disposed at an angle of about 30° to 60° to the horizontal and preferably about 45°. Surface 25 projects laterally outward beyond surface 24.

A plurality of outlet ports 26 are formed in surface 24 and, as illustrated, are arranged in a generally circular pattern. As shown in FIG. 3 ports 26 extend outwardly at an acute angle of about 30° to 60° and generally about 45° with respect to the horizontal. The axes of ports 26 face toward the lower portion of flue 9, as shown in FIG. 2 so that the combustion zone is located in the lower end of the flue.

As illustrated in FIGS. 1 and 2 the horizontal cross sectional area of burner 21 is substantially smaller than the cross sectional area of flue 9 to provide an annular channel for air supply and a passage for falling debris. To provide the most effective flame pattern, it has been found that the cross sectional areas, at the location of the outlet ports 26, should be in the range of 0.5% to 50% with respect to the cross sectional area of the lower end of the flue.

The outer ports 26 should preferably be positioned at a distance from about 3 inches below the lower end of the flue, or any extension that is connected to the lower end of the flue, to about 3 inches above the lower end of the flue or extension for most effective performance. If the outlet ports are located too far upwardly within the flue, the noise level of the combustion process can be increased and the combustion process may suffer from insufficient oxygen, thereby adversely affecting the efficiency of the combustion, and resulting in possible pilot light outages. On the other hand, if the outlets 26 are positioned too far below the lower end of the flue, the flame pattern will be located outside of the flue with a resulting loss of heat.

The quantity of gas entering chamber 23 is controlled by the size or diameter of orifice 20 and by substituting an orifice member with a different sized orifice, the gas energy rate can be readily controlled.

The gas being discharged from outlet ports 26 is directed toward the inner surface of the lower portion of flue 9 and is ignited by the ignition device which results in an annular flame pattern within the flue. By replacing head 21 with a head having a different arrangement or geometry of outlet ports, the flame pattern can be controlled as desired. The size pattern and orientation of ports 26 is designed for each application to provide a flame pattern in which the flame is in close proximity to the flue 9, but does not directly impinge on the internal surface of the flue, as impingement could adversely affect the combustion.

The diverging surface 25 of head 21 serves as a shield to prevent foreign material from falling onto or entering the ports 26 to thereby prevent clogging of the ports.

The drawings have shown the burner used in conjunction with a water heater, but it is contemplated that the burner can also be used in other heating applications.

FIG. 10 illustrates a modified form of the burner. In this embodiment the burner 28 includes a base 29 having a central passage 30 and an orifice member 31, similar in construction to orifice member 17 of the first embodiment, is threaded in the inner end of passage 30 and defines a small diameter orifice 32.

Head 33 is threaded on base 29 and defines a chamber 34 that communicates with orifice 32. Head 33 is formed with a first group of radially extending outlet ports 35 that are arranged in a generally circular pattern and a second group of longitudinally extending outlet ports 36, also arranged in a generally circular pattern. The orientation of ports 35 and 36 provides an annular flame pattern that is in close proximity to flue 9, but does not directly impinge on the surface of the flue.

Head 33 is provided with an enlarged end 37 that serves as a shield to prevent foreign material or debris from entering the ports 35 and 36.

While FIGS. 1–4 have illustrated the burner construction of the invention as associated with a conventional water heater having a concave lower head, the invention has particular application to a water heater having a convex lower head, as illustrated in FIGS. 5–7. The water heater of this embodiment includes a tank 38 to contain water to be heated, and the tank is composed of a generally cylindrical shell 39, enclosed at its upper end by an upper head 40 and at its lower end by a downwardly convex lower head 41. Lower head 41 is designed with a curvature to provide optimum physical properties for the tank, as well as providing effective convection flow of the water in the tank to thereby aid in preventing stratification of the water within the tank.

Water is introduced into the tank through an inlet pipe or dip tube 42 having a plurality of outlet holes 42a in its lower end, and heated water is withdrawn from the upper end of the tank through an outlet pipe 43. A drain valve 44 is located in the bottom head for draining the water from the tank. The convex bottom head 41 has the advantage of directing all sediment toward the area of drain valve 44, where it can be easily flushed from the tank during draining.

Mounted centrally within tank 38 is a flue 45, and as shown in FIG. 5, the flue has a large diameter lower end 46 which is secured within an opening in lower head 41 while the small diameter upper end 47 is secured within an aligned opening in upper head 40. A flue section 48 of intermediate diameter connects the larger diameter lower end 46 and the small diameter upper end.

A baffle 49 can be suspended from the upper edge of flue 45 to increase the heat transfer between the waste gases of combustion passing upwardly within the flue and the water in the tank 38. It is preferred that the vertical distance between the lower end of baffle 49 and the upper end of burner 55 be in the range of 5 to 20 inches for best performance. If the lower end of the baffle 49 is less than 5 inches from the burner, the flame pattern may contact the baffle which could adversely affect combustion. On the other hand, if the distance is greater than 20 inches, heat transfer will be reduced at the lower end of the flue with a resulting loss of efficiency.

Surrounding tank 38 is a jacket 50 and the lower end of jacket 50 is mounted within the upstanding peripheral flange of a base 51. A layer of insulating material 52, which can take the form of fiber glass or a foamed resin material, or both, is located in the space between jacket 50 and tank 38. As specifically shown in FIG. 5, the insulation layer 52 extends beneath the lower head 41, to the lower end 46 of flue 45 and takes the form of a foamed resin. An annular layer of fiber glass 53 surrounds the lower end 46 of flue 45 and extends to jacket 50. The layer 53 serves as a dam to confine the liquid resin as it is introduced into the space between jacket 50 and tank 38 during the foaming operation. A sheet 54 of non-combustible material, such as metal, can be applied to the lower surface of layer 54.

A gas burner 55, similar in construction to burner 8 of the first embodiment, is located adjacent to the lower end of flue 45, as shown in FIG. 5. To control the operation of burner 55, a conventional thermostat 56 is mounted within an opening in tank 38 and operates a gas supply valve 57, which supplies gas through a supply tube 58 to burner 55.

As previously described, burner 55 is constructed and arranged so that the flame pattern is in proximate relation to the inner wall of flue 45, but does not impinge directly on the flue. During the combustion process, condensate will be generated and the condensate will drip downwardly along the inner surface of flue 45 and is collected in a drip pan 61 located beneath the burner and supported on base 51. As the burner 55 has a substantially smaller diameter, or cross sectional area, than the flue, the condensate dripping downwardly along the flue 45 will not contact the burner 55, thus preventing any interference with the combustion process and also minimizing the possibility of corrosion of the burner components. Falling debris also falls through this gap.

In order to optimize the combustion process, burner 55 should be coaxially located with respect to flue 45 and in the construction as shown in FIGS. 5–7, a locator 62 is employed to center the burner. Locator 62 is formed with a central opening which receives burner 55, and a plurality of flexible tabs 63 border the opening and engage the outer surface of the burner to secure the burner to the locator.

As best illustrated in FIG. 6, locator 62 is provided with a group of radially extending arms 64 and the outer end of each arm is provided with an upwardly extending flange 65 which engages the outer surface of flue end 46. Locator 62 is preferably formed of a flexible metal and as the locator is moved upwardly with respect to the flue, flanges 65 will be deflected outwardly by the flue, and the resiliency of the flanges will hold the locator is position relative to the flue. Locator 62 provides a simple yet effective device for accurately centering burner 55 with respect to flue 45. If desired, the upper surfaces of arms 64 can be upwardly curved or convex to prevent foreign material or condensate from collecting on the arms.

Locator 62 can also be employed with the tank construction of FIG. 1. In that case the flanges 65 on arms 64 would engage the inner surface of the flue, rather than the outer surface as shown in FIG. 5.

FIGS. 8 and 9 illustrates a modified form of a device which not only coaxially locates the burner 55 relative to flue 45 but also serves an important function during the application of foam insulation to the tank. The locator includes a metal cross member 66 composed of a pair of interlocked strips 67 and 68. The strips 67,68 have central vertical interlocking grooves or notches which provide an "egg-crate" type of connection between the strips.

Each strip 67,68 is formed with a generally horizontal ledge or shoulder 70 and the lower end 46 of flue 45 is supported on the ledges 70 as shown in FIG. 9.

Located adjacent each ledge 70 is a second ledge or shoulder 61 and burner 55 rests on ledges 71. The cross member 66 will thus serve to coaxially align burner 55 with flue 45.

The lower edge of each strip 67,68 is formed with a pair of slots 72 and the upstanding flange 73 of drip pan 61 is received in slots 72.

In addition, a metal radiation shield 74 surrounds burner 55, and shield 74 is formed with a vertical gap 75 through which the gas line 58 extends. Shield 74 is centered with respect to burner 55 and flue 45 by engagement of slots 76 in the shield with slots 77 located in the lower edge of strips 67,68.

In fabricating the foam insulated water heater, the fibrous layer 53 and non-combustible sheet 54 are initially slipped upwardly over the lower end 46 of flue 45, and the cross-piece 66 is assembled with radiation shield 74 and drip pan 61 on base 51. The lower end 46 of flue 45 is then positioned on ledges 70 of the cross piece 66. With the tank 38 then supported on cross-piece 66 and sheet 54 supported on the upper edge of cross-piece 66, jacket 50 is slipped downwardly around the tank, and the cross-piece 66 serves to concentrically align the jacket with the tank.

The liquid foamablic resin is then introduced into the upper end of the cavity between tank 38 and jacket 50, and the layer 53 and sheet 54, which are supported by cross-piece 66, act an enclosure or dam at the lower end of the cavity to confine the liquid resin. The resin foams or expands to fill the cavity and bonds to the inner surface of the jacket as well as to the outer surface of the tank. After foaming, the solidified foam 52 distributes the weight of the tank over the entire length of strips 67 and 68 of cross-piece 66.

Thus the components of the locator serve multiple functions. The sheet 54 functions as a dam or barrier during the foaming operation and acts to prevent flame impingement on the insulation during normal use of the water heater. The cross-piece 66 not only serves to concentrically align burner 55 with flue 45, but also functions to align jacket 50 with tank 38 and supports dam or sheet 54 for the foaming operation. Further, in the completed structured the cross-piece 66 acts to carry the weight of the tank through engagement of flue 45 with ledges 70 and through the distribution of the tank weight through the foam 52 to the strips 67 and 68.

With the construction of the invention, combustion takes place within the confines of the flue and as a result, heat loss from the bottom of the water heater during firing is minimized.

As the combustion occurs within the flue, the lower head of the tank can be insulated, thereby reducing standby heat losses. Since the burner has a relatively small cross sectional area, as compared to the flue, condensate from the combustion process will not come in contact with the burner or flame, thus preventing interference with the combustion process and minimizing corrosion of burner components.

The convex lower head provides an improved convection pattern within the tank and any scale or sediment build-up on the bottom head will not appreciably affect heat transfer through the flue to the water.

While the drawings show burners 8, 28 and 55 being cylindrical in shape, the burners can take various shapes and can be formed with wrench flats to receive a wrench or other tool. In addition, as illustrated, the gas line can be connected either to the bottom or to the side of the burner. In certain applications it may be desired to arrange the outlet ports in the burner in a manner to obtain a relatively wide flame pattern that would play against the bottom concave head of the tank rather than the flame pattern being directed into the flue.

Various modes of carrying out the invention are contemplated as being within the scope of the following claims particularly pointing out and distinctly claiming the subject matter which is regarded as the invention.

I claim:

1. A water heater, comprising a tank to contain water to be heated and having a downwardly convex lower head, flue means extending upwardly through the tank for conducting waste gases of combustion, said flue means being disposed within an opening in said lower head and the lower end of said flue means projecting downwardly beyond said lower head, heating means located adjacent the lower end of said flue means and having a substantially smaller cross sectional area than said flue means, and a layer of insulation disposed on the outer surface of said convex lower head and extending radially inward to the projecting end of the said flue means, the lower end of said flue means projecting downwardly beyond said layer.

2. The water heater of claim 1, wherein said tank also includes an upper head, said flue means being secured within an opening in said upper head.

3. The water heater of claim 2, wherein said flue means comprises a lower flue section and an upper flue section, said lower section disposed within the opening in said lower head, said lower section and said upper section each having a uniform diameter throughout its length, said lower section having a larger diameter than said upper section and being joined to said upper section by a step disposed upwardly of said lower head.

4. A water heater, comprising a tank to contain water to be heated and having a lower head, flue means extending upwardly through the tank for conducting waste gases of combustion, said flue means being disposed within an opening in said lower head and the lower end of said flue means projecting below the lower head, heating means located adjacent the lower end of said flue means and having a substantially smaller cross sectional area than said flue means, and locator means interconnecting the projecting end of said flue means and said heating means for positioning said heating means with relation to said flue means.

5. The water heater of claim 4, wherein said lower head is downwardly convex.

6. The water heater of claim 4, wherein said heating means has at least one outlet, said outlet being positioned adjacent a horizontal plane extending through the lower projecting end of said flue means.

7. A water heater, comprising a tank to contain water to be heated and including a lower head, a flue extending upwardly through the tank for conducting waste gases of combustion, said flue disposed within an opening in said lower head and the lower end of the flue projecting downwardly below said lower head, heating means located adjacent the lower projecting end of said flue means and having a substantially smaller cross sectional area than said flue, a jacket spaced outwardly of said tank, a layer of insulation disposed in the space between said tank and said jacket, and support means having an upwardly facing surface for supporting the lower projecting end of said flue, said support means being constructed and arranged to support said tank from a foundation.

8. The water heater of claim 7, wherein said support means interconnects said heating means and said flue and is constructed and arranged to support said heating means and position said heating means with respect to said flue.

9. The water heater of claim 8, wherein said support means is also constructed and arranged to align said tank within said jacket.

10. The water heater of claim 9, and including an annular member separate from said layer of insulation and interconnecting the lower projecting end of said flue with said jacket, said annular member being supported on said support means.

11. A water heater, comprising a tank to contain water to be heated and having a lower head, flue means extending upwardly through the tank for conducting waste gases of combustion and disposed within an opening in said lower head, baffle means disposed within said flue means, the lower end of said baffle means spaced above said lower head, the vertical distance between the lower end of said baffle means and the lower end of said flue means being in the range of 5 to 20 inches, and heating means located adjacent the lower end of said flue means.

* * * * *